United States Patent [19]

Arnstein

[11] 4,380,133

[45] Apr. 19, 1983

[54] FLAT PATTERN FOR THREE-DIMENSIONAL RIGID STRUCTURE

[76] Inventor: Bennett R. Arnstein, 3049 W. 8th St., Apt. 435, Los Angeles, Calif. 90005

[21] Appl. No.: 235,012

[22] Filed: Feb. 17, 1981

[51] Int. Cl.[3] ..... A63H 33/00

[52] U.S. Cl. ..... 46/1 L; 434/403

[58] Field of Search ..... 46/1 L, 1 R, 16; 434/211, 403, 277

[56] References Cited

U.S. PATENT DOCUMENTS 1,292,188 1/1919 Wheeler ..... 434/403 X

OTHER PUBLICATIONS

*Polyhedron Models,* Magnus J. Wenninger, Cambridge University Press 1971.

*Mathematical Models,* Cundy and Rollet, Oxford at the Clarendon Press, Great Britain, 2nd Edition 1962, pp. 76–93.

*Primary Examiner*—Mickey Yu

[57] ABSTRACT

A flat pattern is disclosed for forming a three-dimensional structure known as the Great Dodecahedron. The pattern consists of twelve regular pentagons, laid out as for the pattern for a simple dodecahedron on paper or cardboard or similar material. Creases are formed lying along the major diagonals of the twelve pentagons, and the structure is assembled by joining the edges of the pattern with adhesive tape, or tabs, or tabs and slots.

5 Claims, 6 Drawing Figures

FLAT PATTERN FOR THREE-DIMENSIONAL RIGID STRUCTURE

BRIEF SUMMARY OF THE INVENTION

A flat pattern is disclosed for forming a FIGURE known as the Great Dodecahedron. This FIGURE is described on pages 89, 92, and 93 of the book "Mathematical Models" by H. Martyn Cundy and A. P. Rollett, published by Oxford at the Clarendon Press, Great Britain, second edition, 1962. This book will hereafter be referred to as Reference. A flat pattern for the Great Dodecahedron is given on page 93 of Reference, but this pattern has the disadvantage of not developing the full rigidity inherent in the Great Dodecahedron, as pointed out on pages 89 and 93 of Reference. The alternate construction mentioned on page 93 of Reference is made from several separate pieces, not a single flat pattern. The object of my invention is to disclose a flat pattern for forming a Great Dodecahedron that:

1. Is compact and easy to lay out.
2. Is fast and easy to assemble.
3. Develops the full rigidity inherent in the Great Dodecahedron without having to be reinforced.

DETAILED DESCRIPTION

Figure 1:
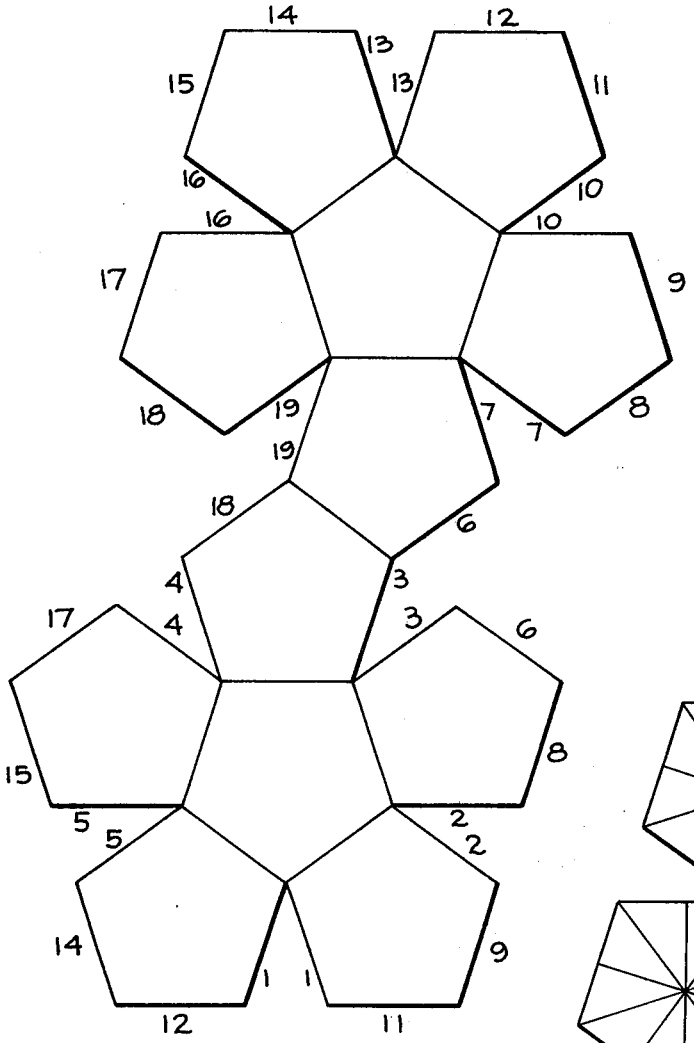
FIG. 1 is the familiar flat pattern for a simple dodecahedron consisting of twelve regular pentagons.

The pattern of FIG. 1 is formed by cutting it out, folding along the common edges, and joining the identically identified edges, either with adhesive tape, or suitably located tabs, or suitably located tabs and slots.

Figure 2:
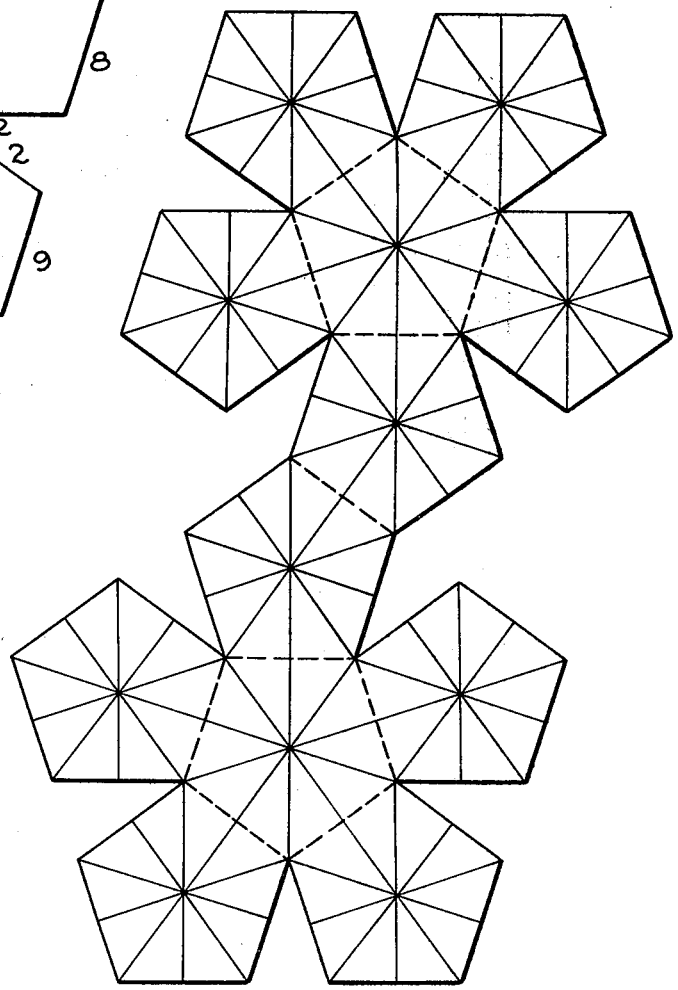
FIG. 2 is the pattern of FIG. 1 with the addition of the major diagonals of all the pentagons.
Figure 3:
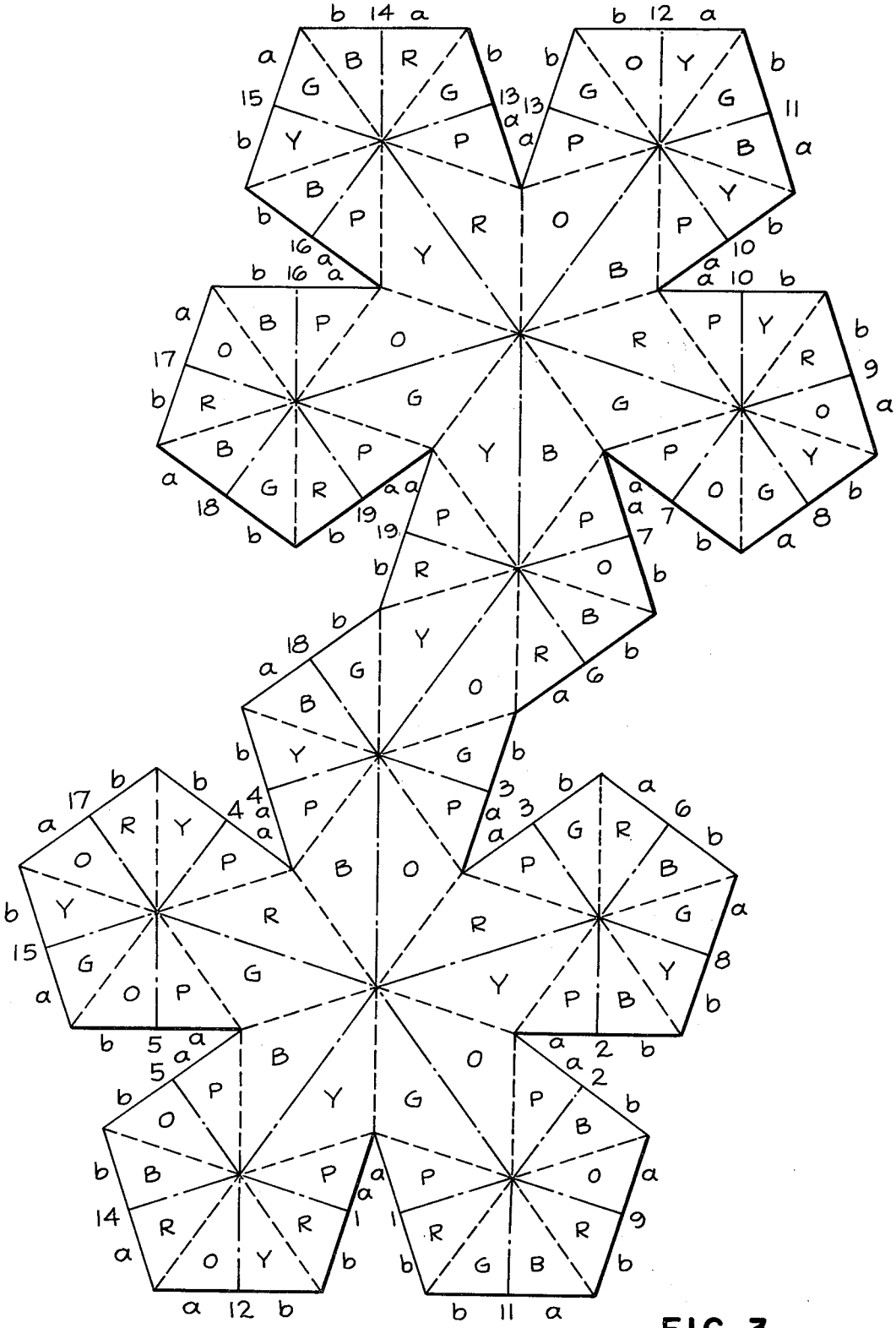
FIG. 3 is the flat pattern disclosed herein, creases being formed on the diagonal lines added in FIG. 2.
Figure 4:
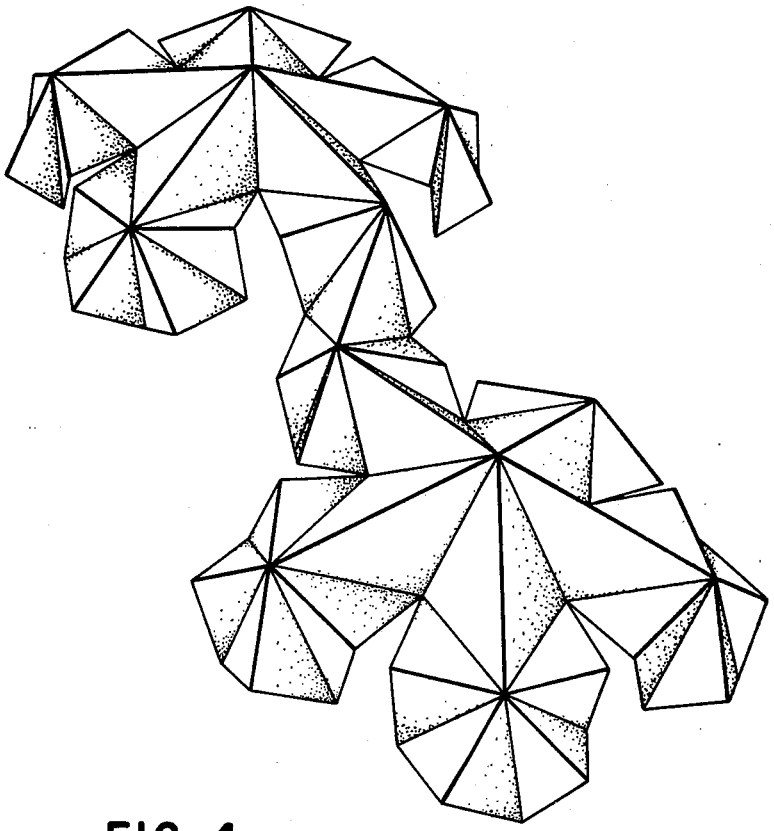
FIG. 4 is a perspective drawing showing the pattern after it has been cut out and creased as indicated in FIG. 3.
Figure 5:
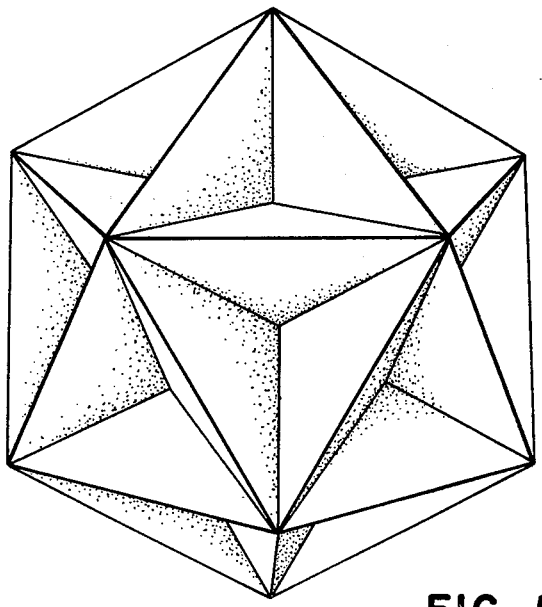
FIG. 5 is a perspective drawing showing the pattern of FIG. 4 assembled to form a great dodecahedron.
Figure 6:
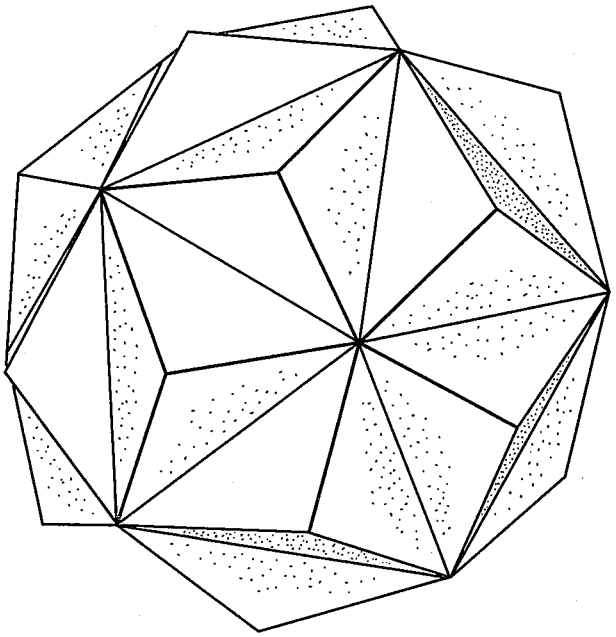
FIG. 6 is a perspective drawing of a stellated icosahedron.

In FIG. 2, the lines shown dashed may be ignored or erased and are omitted from FIG. 3. In FIG. 3, up-facing creases are indicated symbolically by alternate long and short dashes, while down-facing creases are indicated symbolically by a series of short dashes. One possible coloring scheme is indicated by the capital letters R,O,Y,G,B,P, which stand for the colors red, orange, yellow, green, blue, and purple. The edges are numbered similarly to FIG. 1, while the lower case letters "a" and "b" denote the equal parts into which each edge is divided by the up-facing creases. In FIG. 5, the identically identified edges of FIG. 3 have been joined to each other with adhesive tape. The improved rigidity of my novel pattern is due to the fact that a maximum of only three joined edges meet at the indented Trihedral vertices, and the joined edges all lie on the flat surfaces of the Great Dodecahedron. The prior pattern has a maximum of five joined edges meeting at a vertex, and the joined edges all lie along the edges of the Great Dodecahedron.

The edge identification given in FIG. 3 is to indicate the similarity to the formation of the simple dodecahedron from the pattern of FIG. 1. In actual practice, edge identification is not needed, as there is only one way to assemble the pattern.

When the pattern is duplicated on a copying machine, the crease lines should be lightly scored with a ballpoint pen before making the creases. All the scoring may be done on the same side of the paper.

The compactness, simplicity, ease of assembly, and rigidity of my novel pattern enhance its application to the following fields:

1. Educational
2. Handicraft
3. Decorative ornament
4. Structural containers

I claim:

1. A flat pattern laid out on a thin flexible sheet of material that can be written or printed or painted or marked upon and that can be folded and creased to form a three-dimensional structure, consisting of twelve regular pentagons connected to form a flat pattern for a simple dodecahedron, each pentagon having diagonals bisecting the corner angles of said pentagons, crease lines lying along said diagonals, up-facing creases being directed toward the side edges of said pentagons, down-facing creases being directed toward the corners of said pentagons, whereby a great dodecahedron is formed when the side edges of said pentagons are joined.

2. The pattern of claim 1 wherein at least one tab is located on at least one of the joined side edges.

3. The pattern of claim 1 or 2 wherein indicia are located on said thin flexible sheet.

4. The pattern of claim 1 or 2 wherein said up-facing creases and said down-facing creases are interchanged, whereby a stellated icosahedron is formed when the side edges of said pentagons are joined.

5. The pattern of claim 3 wherein said up-facing creases and said down-facing creases are interchanged, whereby a stellated icosahedron is formed when the side edges of said pentagons are joined.

* * * * *